US005351354A

United States Patent [19]

Hasumi et al.

[11] Patent Number: 5,351,354

[45] Date of Patent: Oct. 4, 1994

[54] DUST CLEANER AND DUST CLEANING METHOD

[75] Inventors: Kazuo Hasumi; Mamoru Kato; Isaburou Omori, all of Tokyo, Japan

[73] Assignee: Seiko Instruments Inc., Japan

[21] Appl. No.: 840,342

[22] Filed: Feb. 24, 1992

[30] Foreign Application Priority Data

Feb. 27, 1991 [JP] Japan ..... 3-033235

[51] Int. Cl.[5] ..... B08B 5/02; B08B 6/00; B08B 7/00

[52] U.S. Cl. ..... 15/1.51; 15/304; 15/306.1; 15/309.2; 15/316.1

[58] Field of Search ..... 15/309.2, 1.51, 306.1, 15/304, 316.1

[56] References Cited

U.S. PATENT DOCUMENTS

| | | | |
|---|---|---|---|
| 3,956,791 | 5/1976 | Rütten | 15/304 X |
| 4,727,614 | 3/1988 | Swistun | 15/309.2 X |
| 4,854,004 | 8/1989 | Omata et al. | 15/304 |
| 4,854,441 | 8/1989 | McBrady et al. | 15/309.2 X |
| 4,883,542 | 11/1989 | Voneiff | 15/1.51 X |
| 4,987,630 | 1/1991 | Allen et al. | 15/1.51 |
| 5,012,547 | 5/1991 | Marsh | 15/309.2 X |

FOREIGN PATENT DOCUMENTS

| | | |
|---|---|---|
| 0784685 | 10/1957 | United Kingdom . |
| 1419337 | 12/1975 | United Kingdom . |

*Primary Examiner*—Chris K. Moore

*Attorney, Agent, or Firm*—Bruce L. Adams; Van C. Wilks

[57] ABSTRACT

To improve dust removing performance and to prevent re-adhesion of dust in dust cleaner for removing dust adhering to the surface of an object such as a timepiece component by effecting blow-off dust removal and charge elimination by the use of a clean compressible fluid and an electric static ion eliminator. A clean compressible fluid is discharged from a clean compressible fluid nozzle to an object. When the object is an electrostatically charged article, an electric static ion mix clean compressible fluid containing electric static ions generated from an electric static ion eliminator is discharged to the object. It is possible to employ the structure wherein the object is set into a blow washing tray, and is moved up and down by the emission of the clean compressible fluid.

15 Claims, 4 Drawing Sheets

DUST CLEANER AND DUST CLEANING METHOD

BACKGROUND OF THE INVENTION

1. Field of the Invention

This invention relates to a dust cleaner and dust cleaning method for removing dust adhering to the surface of an object.

2. Description of the Prior Art

In a conventional dust cleaner for removing dust adhering to the surface of an object, a compressible fluid sent from a blower 2 is blown out from a Punkah louver 4 through a high efficiency particulate air filter 3, as shown in FIGS. 3 and 4. An apparatus is known wherein an object 0 passes on rollers 6 and dust adhering to the surface of the object is blown off by this compressible fluid.

There is also known an apparatus which generates ionized air by corona discharge, removes static electricity of a charged article by blowing the ionized air, then blows compressed air from an air nozzle to the article from which the charge is thus removed, so as to remove dust adhering to the surface of the article, and then sucks and removes the removed dust by a duct.

In production plants of ICs, a method is known which blows off the dust at each fabrication step using high pressure air blown from an air blower. The dust is blown off by an exhaust duct and prevented from once again adhering to the integrated circuit.

Such technology is disclosed, for example, in Japanese Patent Laid-Open No. 267414/1988 and No. 130169/1988.

However, the conventional dust cleaner for removing dust adhering to a surface has the problem in that static electricity charged on the lower surface of the object, as its upper support side, and on its surface cannot be removed, and the floating dust is allowed to once again adhere to the object.

SUMMARY OF THE INVENTION

It is an object of the present invention to remove the dust adhering to the entire surface of the object by emitting a clean compressible fluid from a nozzle disposed on the same side as support means of the object. Ions from an electrostatic ion generator are used to remove static electricity charged on the object, and to prevent re-adhesion of the floating dust.

To solve the problem described above, in accordance with the present invention, a clean compressible fluid is blown to an object from a plurality of clean compressible fluid nozzles disposed on the same side as object support means. Ions are omitted from an electrostatic ion generator and the ions are blown from a plurality of nozzles which are the same as the nozzles for the clean compressible fluid, in order to remove static electricity which would otherwise charge the object. A plurality of electrostatic ions are emitted from above and from both sides of the object support means in order to uniformly remove the dust and static electricity from the object as a whole. Object support moving means is used for removing dust and static electricity from the entire surface of the object. At least one object detection means is used for recognizing the presence of the object.

In accordance with the invention having the construction described above, the object or objects are placed in a blow washing tray, a blow washing basket, an oppress net lid, etc, and are put onto a belt conveyor of the object support means. The object support means moves until the objects pass by a dust removing chamber.

To remove the dust from the object, an operation switch used for moving the object support means is turned on. At this time, a blower inside the dust removing chamber is operated simultaneously with the start of the movement of the object support means, and a clean fluid passing through a high efficiency particulate air filter is blown out from a punkah louver provided on both side surfaces and the upper part of the chamber, and cleans the inside of the chamber.

As the objects move on the support means, the tray and basket pass by a photoelectric tube operation sensor on the front side in the travelling direction inside the dust removing chamber. At this time, the compressible fluid passes through a filtration filter from a downward direction on the same side as the object support means, and the clean compressible fluid at a pressure of 1–10 $kg/cm^2$ is discharged from a plurality of clean compressible fluid nozzles. At the same time, electrostatic ions for removing the static electricity charged to the object are emitted from the same nozzles, and the dust blow off from the object is sucked to the lower part of the object support means, then returns to the blower, and is purified by the high efficiency particulate air filter and then is emitted into the dust removing box from the Punkah louver.

The object is blown up by the pressure of the clean compressible fluid disposed at the lower part on the same side of the support means, and the adhering dust falls off from the object when vibration is applied. Here, the electrostatic ions are blown to the object which is vibrated and abraded lest it is again charged electrostatically. The object then moves along as a non-charged article, and when it passes by a stop sensor (a photoelectric tube disposed at the rear part in the travelling direction), the flow of the clean compressible fluid and the electrostatic ion generator is quickly stopped.

DETAILED DESCRIPTION OF THE PREFERRED EMBODIMENTS

Hereinafter, an embodiment of the present invention will be explained with reference to the drawings.

Figure 1:
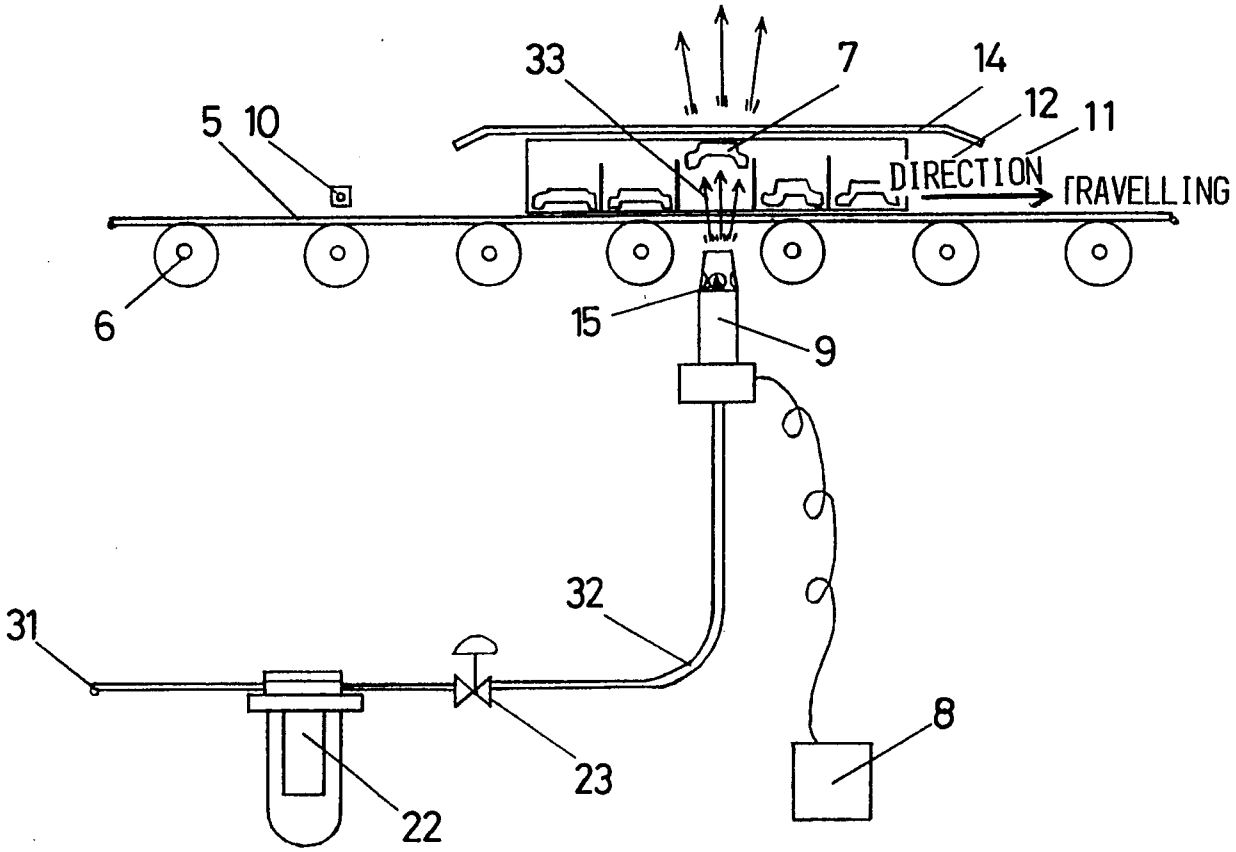
FIG. 1 is an explanatory view of a dust cleaner in accordance with the present invention.

In FIG. 1, a case 7 of a timepiece as the object to be cleaned is placed on a blow washing tray 12 in such a manner that glass of the case 7 faces up. The blow washing tray 12 has a net-like shape at the bottom and is partitioned into matrix to store a plurality of objects therein. After the objects 7 are set, an oppress net lid 14 is placed on the blow washing tray 12. This lid 14 is net-like in order to improve the passage of air. The lid 14 prevents the objects 7 from being blown off the blow washing tray 12.

A belt 5 is driven and moved by a plurality of rollers 6. The blow washing tray 12 is placed on the belt 5.

The blow washing tray 12 is moved simultaneously with the operation of the belt 5 by a driving mechanism (not shown in the drawing).

When the moving blow washing tray 12 crosses the position of an operation sensor 10 using a photoelectric tube, a clean compressible fluid 32 is discharged from a clean compressible fluid nozzle 9.

The clean compressible fluid 32 is produced from a compressible fluid 31 by a filtration filter 22. The filtration filter 22 incorporates a filter for removing particulate dust of greater than 0.01 $\mu$m, for example, and can withstand a compressible fluid pressure of up to about 10 kg/cm$^2$.

After the clean compressible fluid 32 passes through the filtration filter 22, its pressure is regulated by a clean compressible fluid pressure reducing valve 23. The pressure can be changed within the range of about 1 to 10 kg/cm$^2$. It is set to about 2 kg/cm$^2$, for example.

When the object 7 is an electrostatically charged article, electric static ions are emitted by the electrostatic ion eliminator 8 from an electrostatic ion emission needle 15. At this time, an electric static ion mix clean compressible fluid 33 is discharged from the clean compressible fluid nozzle 9.

A structure is sometimes employed wherein the object 7 is moved up and down inside the blow washing tray 12 by the electric ion mix clean compressible fluid 33. The size of each compartment inside the tray is set to be somewhat greater than the object 7, lest the objects 7 move upside down or mutually overlap, and the height of the partition is set to be smaller than the outer shape of the object 7. At this time, the dust adhering to the object 7 is blown off by the clean compressible fluid 32. When the object 7 is charged electrostatically, the dust is removed and static electricity is eliminated by the electrostatic ion mix clean compressible fluid 33.

When the moving tray 12 passes by the stop sensor 11 comprising the photoelectric tube after the dust removing operation is completed, emission of the clean compressible fluid 32 or electric static ion mix clean compressible fluid 33 is stopped.

Figure 2:
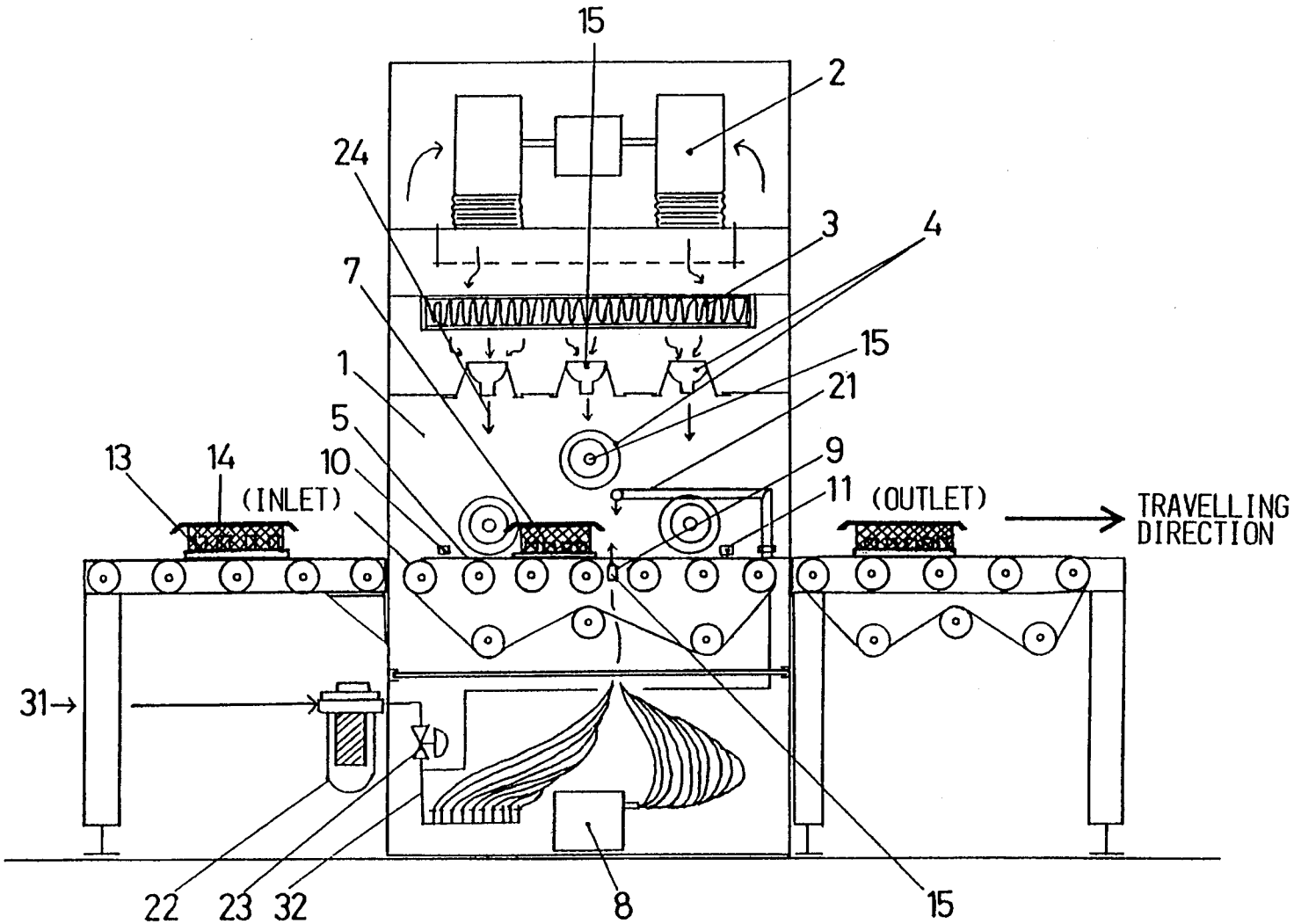
FIG. 2 is a side view of the dust cleaner in accordance with the present invention.
Figure 3:
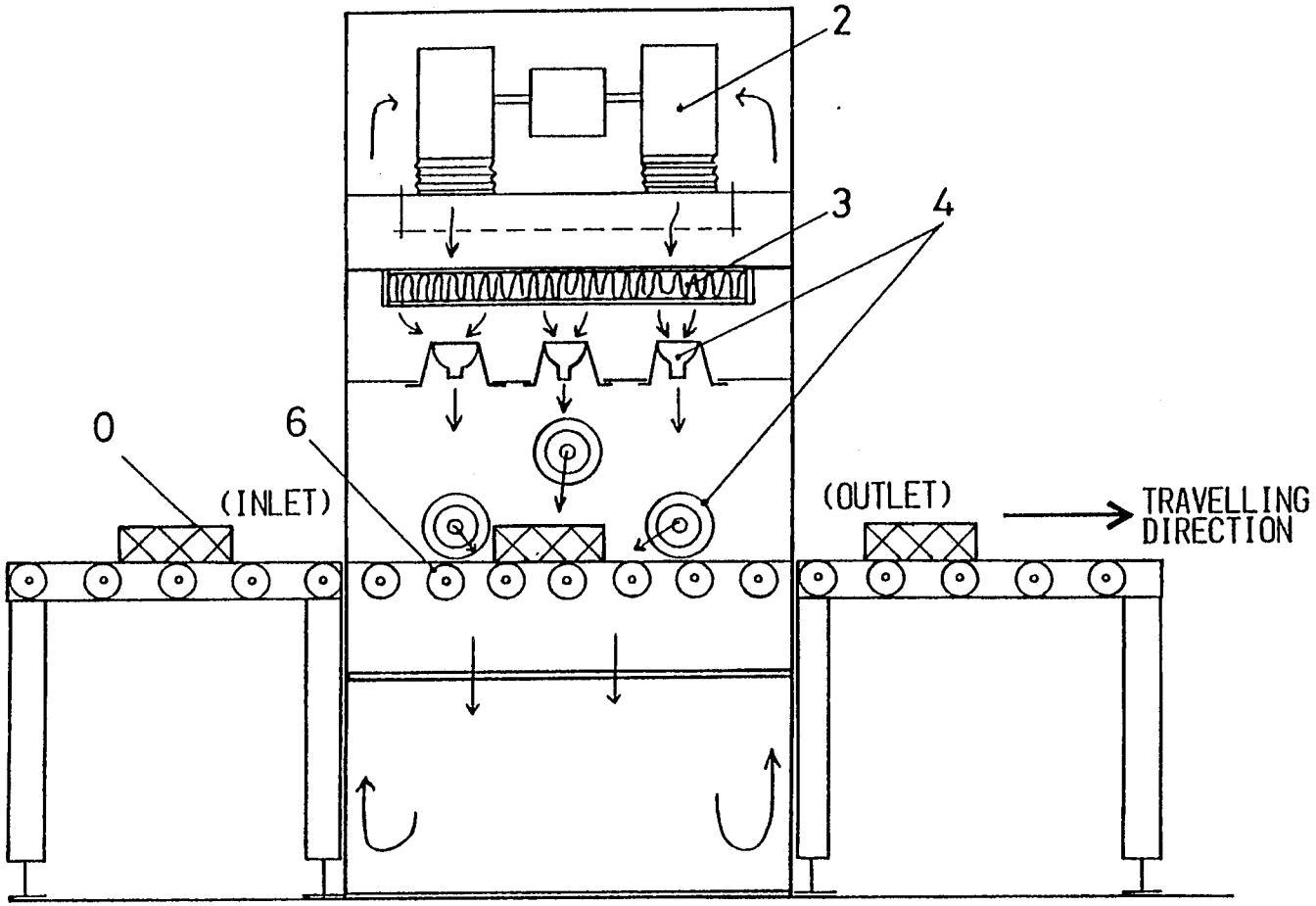
FIG. 3 PRIOR ART
FIG. 3 is a side view of a conventional dust cleaner.
Figure 4:
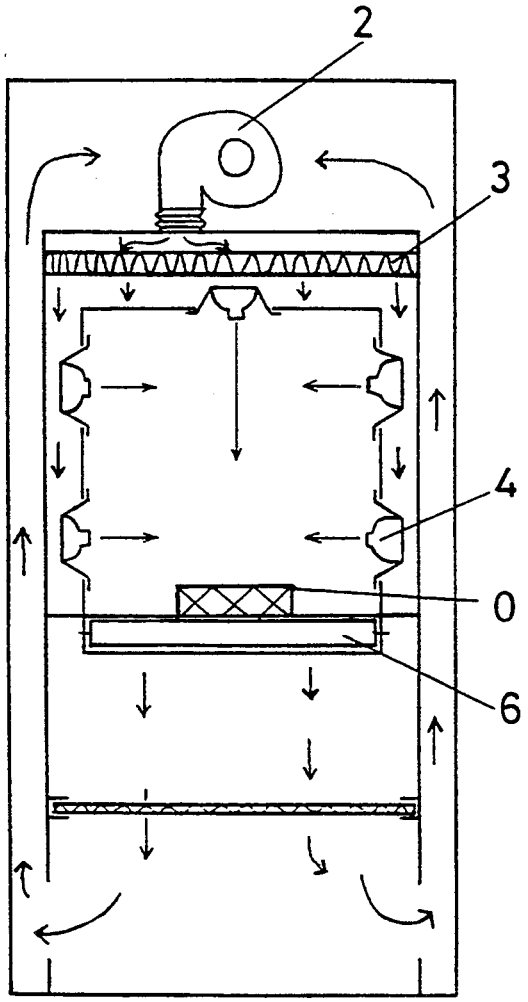
FIG. 4 PRIOR ART
FIG. 4 is an explanatory view showing the flow of a compressible fluid in the conventional dust cleaner.

In FIG. 2, the compressible fluid discharged from the blower is cleaned by the high efficiency particulate air filter 3 and is discharged as the clean air 24 from the Punkah louver 4 into the dust removing chamber 1.

When the upper surface of the object 7 must further be cleaned, the clean compressible fluid 32 or the electrostatic ion mix clean compressible fluid 33 is discharged from the upper clean compressible fluid nozzle 21.

When the object 7 is not placed into the blow washing tray 12, the dust is removed in the blow washing basket 13. No partition is necessary for the blow washing basket 13.

The electrostatic ion emission needle 15 is disposed inside the Punkah louver 4 in order to eliminate charge inside the dust removing chamber 1 as a whole.

The compressible fluid in the present invention is an inert gas having high stability other than a liquid, such as air, nitrogen gas, and argon. Besides the components of timepieces, the object 7 may be a semiconductor material, a glass sheet, food package surface, plastic, ceramic, etc. Where higher quality is required, the dust removing chamber 1 or the main body as a whole has a positive pressure sealed structure.

When the object 7 comprises components associated with semiconductors, the objects 7 can be set not only parallel to the belt surface, but also at right angles or at a predetermined angle to the belt surface.

As described above, in the dust cleaner for removing the dust adhering to the surface, the present invention uses means for directly blowing the clean compressible fluid to the object, electrostatic ion generator means for eliminating static electricity charged on the object by the electrostatic ion mix clean compressible fluid, means for blowing from the lower part direction of the object and the operation sensor and stop sensor means using the photoelectric tube. Accordingly, not only the dust adhering to the upper surface and side surfaces of the object but also the dust adhering to the object on the support means side can be removed. When the object is electrostatically charged, static electricity can also be eliminated by the use of the electrostatic ion mix clean compressible fluid. Therefore, dust removing performance can be improved and re-adhesion of the dust hardly occurs.

What is claimed is:

1. A dust cleaner for removing dust adhering to the surface of an object by blowing a compressible fluid, comprising:

a fluid permeable container for containing an object;

a clean compressible fluid nozzle for blowing a clean compressible fluid to said object;

filtration filter means for supplying said clean compressible fluid to said clean compressible fluid nozzle; and electrostatic elimination means for mixing and blowing electrostatic ions from an electrostatic ion generator into said clean compressible fluid in order to eliminate charged static electricity on said object.

2. A dust cleaner for removing dust adhering to the surface of an object by blowing a compressible fluid, comprising:

a fluid permeable container for containing an object;

a clean compressible fluid nozzle for blowing a clean compressible fluid to said object;

filtration filter means for supplying said clean compressible fluid to said clean compressible fluid nozzle;

container moving means for moving said container; and at least one container detection means for detecting the presence of said container and controlling the flow of the clean compressible fluid in response thereto.

3. An apparatus for removing dust from the surface of an object, comprising: a fluid permeable container for containing an object; blowing means for blowing a clean compressible fluid through the fluid permeable container and over substantially the entire exposed surface of the object to remove dust from the object; and eliminating means for eliminating electrostatic charge from the surface of the object, the eliminating means comprising an electrostatic ion generator for generating electrostatic ions, and mixing means for mixing the electrostatic ions with the clean compressible fluid prior to blowing the fluid through the fluid permeable container and over the surface of the object.

4. An apparatus for removing dust from the surface of an object according to claim 3; further comprising filtering means for filtering a compressible fluid to obtain the clean compressible fluid.

5. An apparatus for removing dust from the surface of an object, comprising: a fluid permeable container for containing an object; blowing means for blowing a clean compressible fluid through the fluid permeable container and over substantially the entire exposed surface of the object to remove dust from the object; and container moving means for sequentially moving the fluid permeable container from a first position where the clean compressible fluid is not blown through the fluid permeable container to a second position where the clean compressible fluid is blown through the fluid permeable container to a third position where the clean compressible fluid is not blown through the fluid permeable container; and container detecting means for detecting whether the fluid permeable container is at at least one of the first, second or third position and for controlling the blowing means in response thereto.

6. An apparatus for removing dust from the surface of an object, comprising: a fluid permeable container for containing an object; blowing means for blowing a clean compressible fluid through the fluid permeable container and over substantially the entire exposed surface of the object to remove dust from the object; and container moving means for sequentially moving the fluid permeable container from a first position where the clean compressible fluid is not blown through the fluid permeable container to a second position where the clean compressible fluid is blown through the fluid permeable container to a third position where the clean compressible fluid is not blown through the fluid permeable container; and container detecting means for detecting when the fluid permeable container is at the second position and for controlling the blowing means in response thereto to start blowing the clean compressible fluid through the fluid permeable container and over the surface of the object.

7. An apparatus for removing dust from the surface of an object, comprising: a fluid permeable container for containing an object; blowing means for blowing a clean compressible fluid through the fluid permeable container and over substantially the entire exposed surface of the object to remove dust from the object; and container moving means for sequentially moving the fluid permeable container from a first position where the clean compressible fluid is not blown through the fluid permeable container to a second position where the clean compressible fluid is blown through the fluid permeable container to a third position where the clean compressible fluid is not blown through the fluid permeable container; and container detecting means for detecting when the fluid permeable container is at the third position and for controlling the blowing means in response thereto to stop blowing the clean compressible fluid through the fluid permeable container and over the surface of the object.

8. An apparatus for removing dust from the surface of an object according to claim 3; wherein the fluid permeable container comprises a tray having a fluid permeable bottom.

9. An apparatus for removing dust from the surface of an object according to claim 3; wherein the fluid permeable container comprises a tray having a fluid permeable bottom and fluid permeable sides to allow the blowing means to blow the clean compressible fluid through the bottom and sides of the tray and over the bottom and sides of the object.

10. An apparatus for removing dust from the surface of an object according to claim 3; wherein the fluid permeable container comprises a tray having a fluid permeable bottom, and a lid removably disposed over the top of the tray to prevent the object from being blown out of the tray.

11. An apparatus for removing dust from the surface of an object according to claim 10; wherein the lid is a fluid permeable lid.

12. An apparatus for removing dust from the surface of an object according to claim 3; wherein the fluid permeable container comprises a tray having a fluid permeable bottom and fluid permeable sides to allow the blowing means to blow the clean compressible fluid through the bottom and sides of the tray and over the bottom and sides of the object, and a lid removably disposed over the top of the tray to prevent the object from being blown out of the tray.

13. An apparatus for removing dust from the surface of an object according to claim 12; wherein the lid is a fluid permeable lid.

14. An apparatus for removing dust from the surface of an object according to claim 3; including means partitioning the interior of the fluid permeable container into a plurality of individual fluid permeable compartments each receptive of an object.

15. An apparatus for removing dust from the surface of an object according to claim 14; wherein the individual compartments are dimensioned to prevent the objects contained therein from being flipped over when blown with the clean compressible fluid.

* * * * *